United States Patent [19]

Väänänen

[11] 3,988,867

[45] Nov. 2, 1976

[54] DRAIN AND DUCT SYSTEM FOR BUILDINGS

[76] Inventor: Olavi Väänänen, Porttikuja 2 F 68, 00940 Helsinki 94, Finland

[22] Filed: Nov. 18, 1974

[21] Appl. No.: 524,819

[30] Foreign Application Priority Data

May 18, 1973 Finland ..... 1623/73

[52] U.S. Cl. ..... 52/221; 52/220

[51] Int. Cl.[2] ..... E04B 5/48

[58] Field of Search ..... 52/220, 221, 236

[56] References Cited

UNITED STATES PATENTS

| | | | |
|---|---|---|---|
| 1,611,261 | 12/1926 | Youngblood | 52/221 |
| 1,683,600 | 9/1928 | Black | 52/220 |
| 2,438,411 | 3/1948 | Meiller | 52/220 |
| 3,188,694 | 6/1965 | Hammar | 52/220 |
| 3,321,875 | 5/1967 | Conradt | 52/221 |
| 3,601,937 | 8/1971 | Campbell | 52/220 |
| 3,694,973 | 10/1972 | Unger | 52/236 |
| 3,766,574 | 10/1973 | Smid | 52/220 |
| 3,846,946 | 11/1974 | Sandstrom | 52/221 |
| 3,885,296 | 2/1975 | Stout | 52/221 |
| R17,154 | 12/1928 | Purdy | 52/220 |

FOREIGN PATENTS OR APPLICATIONS

| | | | |
|---|---|---|---|
| 612,558 | 1/1961 | Canada | 52/220 |
| 841,639 | 6/1952 | Germany | 52/220 |

*Primary Examiner*—Ernest R. Purser
*Assistant Examiner*—Henry Raduazo
*Attorney, Agent, or Firm*—Paul & Paul

[57] ABSTRACT

A drain and duct system for buildings is provided in which a false ceiling element is fabricated ready furnished with branch drain pipes and a vertical duct element which is used as a vertical drain and may be used as ventilation ducts, wherein all branch drains in the false ceiling element connect and no separate drain pipe need be inserted. The connection of the branch drain elements with those of the vertical drain may be accomplished by inserting a pipe stump through the opening in the wall of the vertical duct element, this opening then being grouted with filling mix or connected by means of a flange joint.

4 Claims, 4 Drawing Figures

DRAIN AND DUCT SYSTEM FOR BUILDINGS

The present invention concerns a drain and duct system for buildings, comprising a false ceiling element of concrete ready-furnished with pipes, and a vertical duct element of concrete containing a vertical drain connecting with the branch drain in the false ceiling element.

A drain and duct system of the type mentioned is known in prior art through the same applicant's earlier Finnish patent application No. 602/69.

The object of the invention is to improved the system mentioned so that the simplest possible way of joining the branch drain and vertical drain is achieved and that the labor and material costs of drainage will be minimized.

This aim is achieved by means of the invention mainly in that the duct in the vertical duct element constitutes the vertical drain without any separate drain pipe to be inserted.

The invention is described in greater detail in the following with reference to the attached drawings, wherein.

Figure 1:
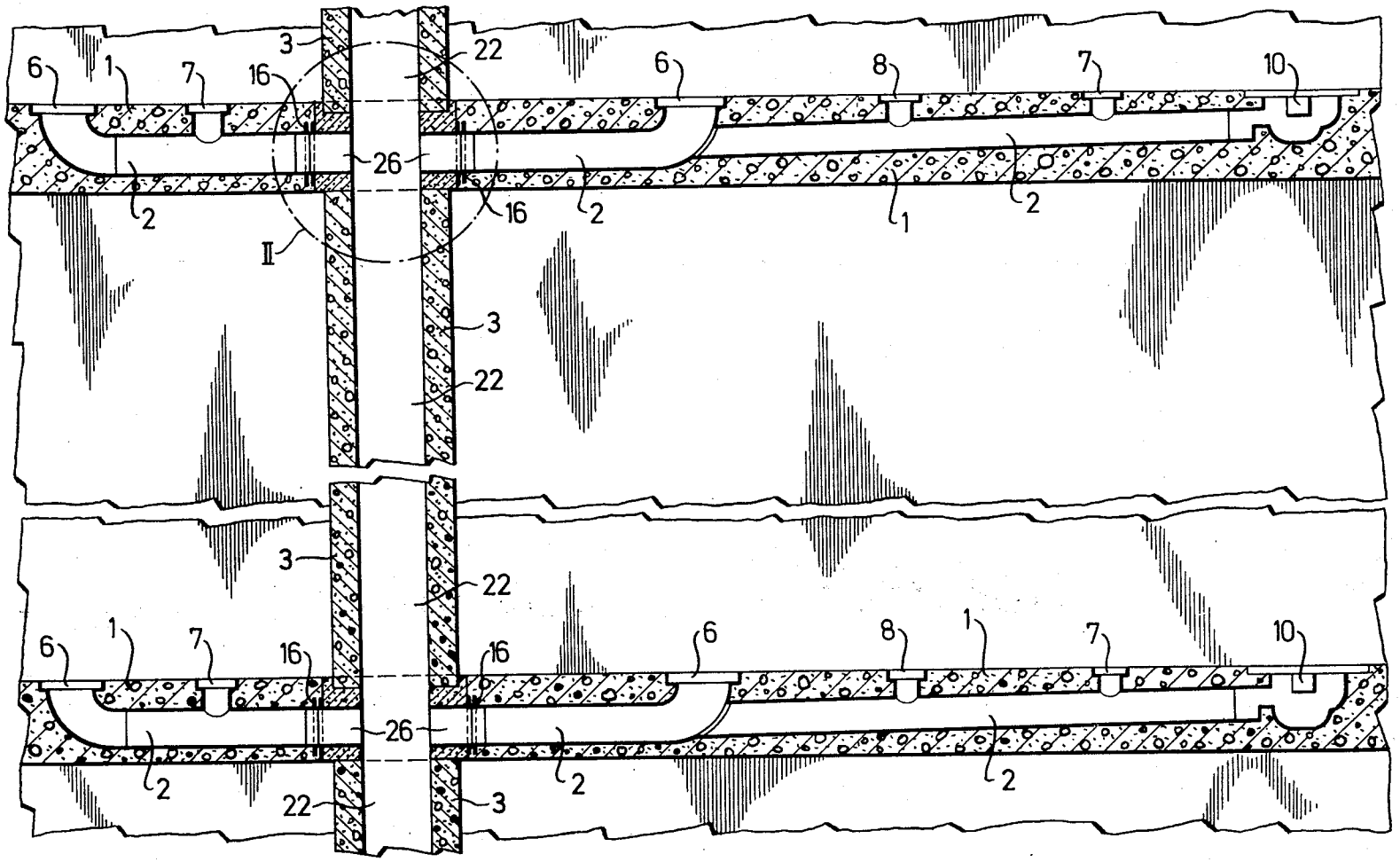
FIG. 1 shows a drain and duct system according to the invention, as a vertical sectional view extending into three different storeys.

Opposite to the spaces of the building to be provided with drains, such as bathrooms and kitchens, the false ceilings between storeys consist of false ceiling elements 1 ready-furnished with pipes and into which branch drains 2 have been concreted, having connection studs 6, 7, 8 and 10 for sanitary fixtures to be provided with a drain connection, such as toilet seat (6), wash basins (7 and 8) and bath tub (floor sink 10).

Through openings in the false ceiling element 1, vertical duct elements of concrete 3 have been placed one upon the other. Partitions 20 have been fitted to divide the vertical duct element into a number of vertical ducts, whereof the vertical duct 22 constitutes the vertical drain and vertical ducts 21 constitute the ventilation ducts. Between the ends of the vertical duct elements 3 placed upon each other a packing 24 has been placed.

After the lower vertical duct element 3 has been inserted through the opening in the false ceiling element, the end of the branch drain 2 will coincide with an opening in the vertical duct element. The connection of the branch drain 2 with the vertical duct 22 constituting the vertical drain is then accomplished.

Figure 2:
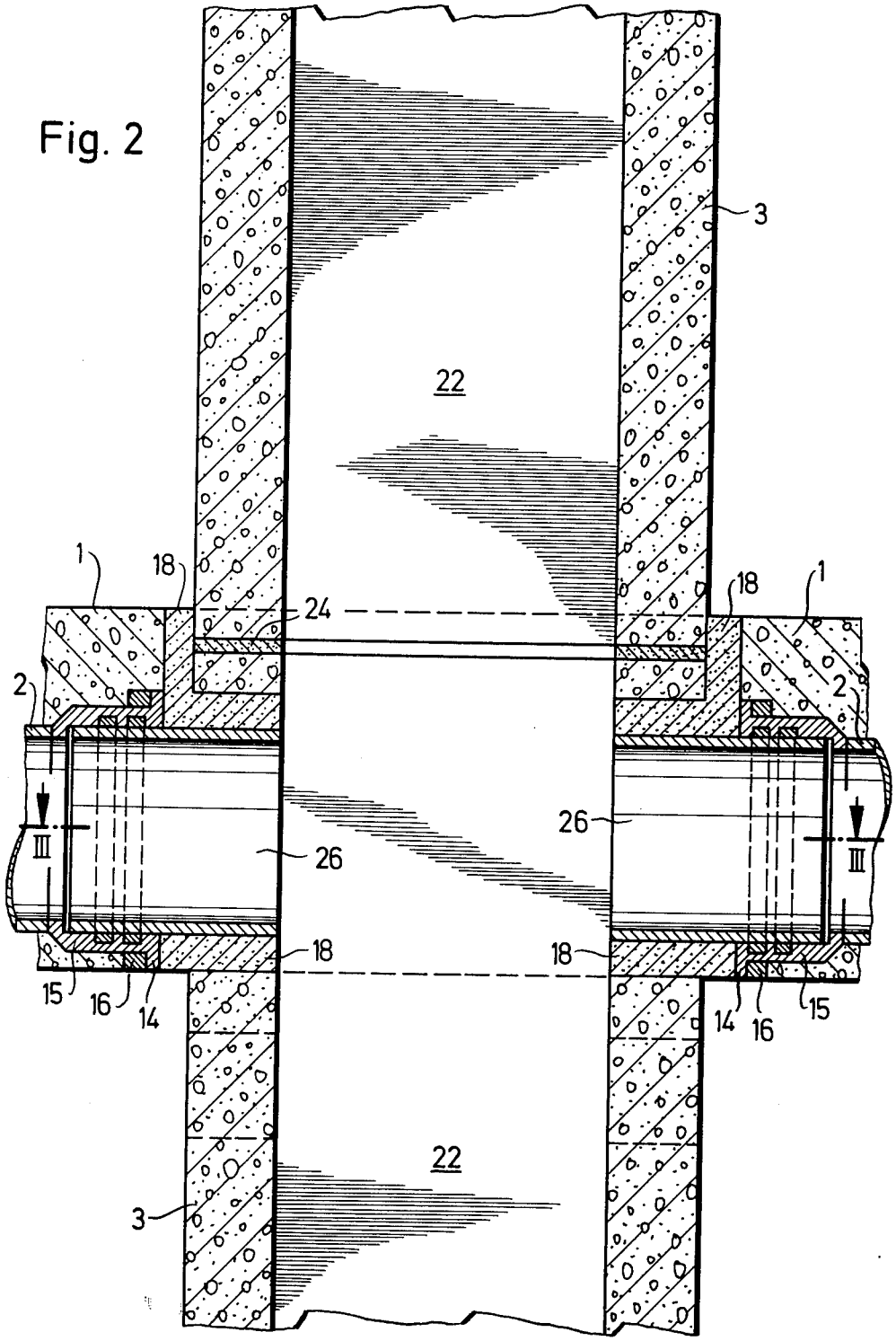
FIG. 2 shows in a vertical section the juncture of the branch drain and vertical drain according to one embodiment of the invention.
Figure 3:
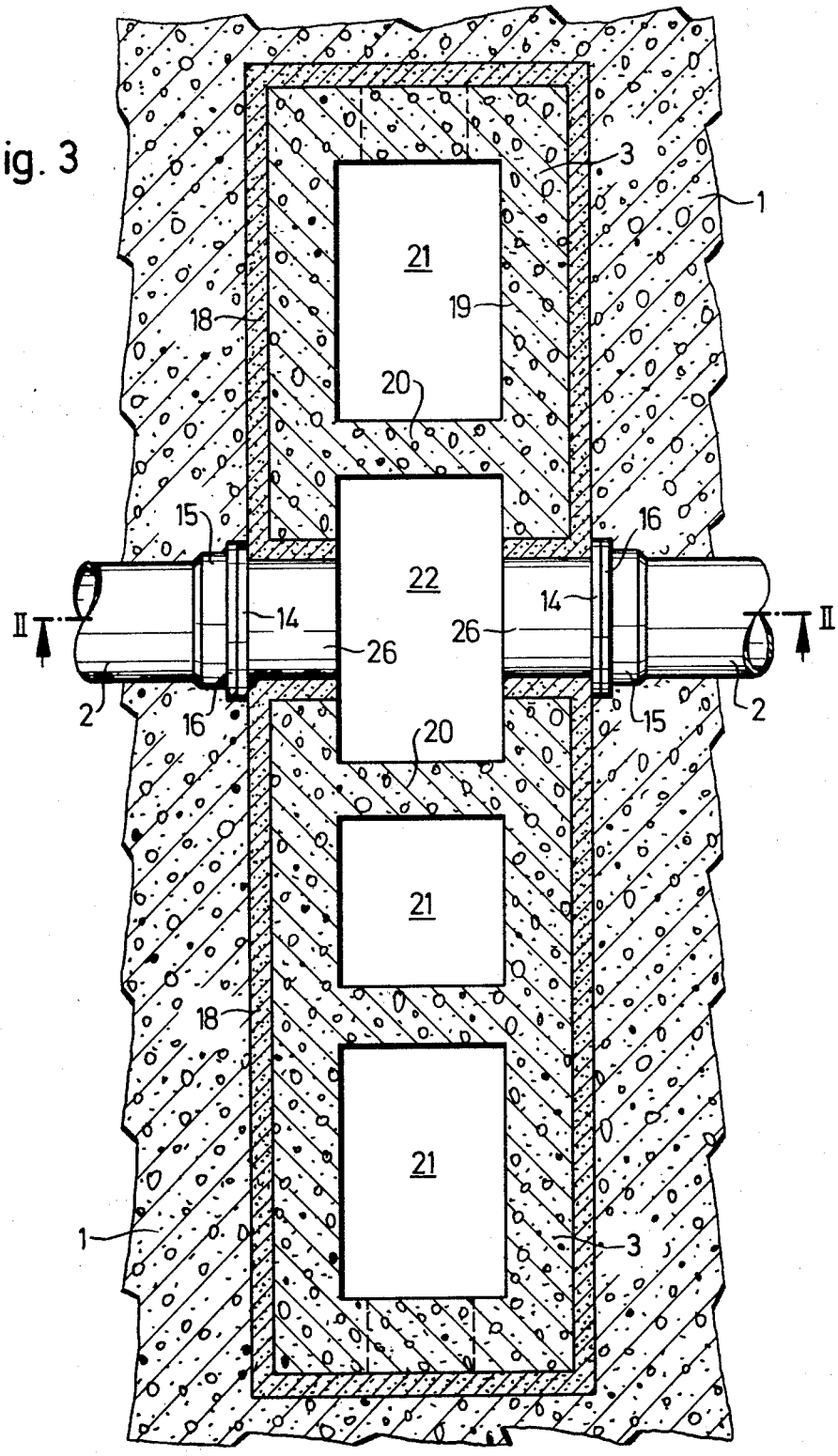
FIG. 3 shows a horizontal section, carried at a false ceiling element, of a drain and duct system according to the invention.

In the embodiment of FIG. 2 the connecting of the branch drain 2 with the vertical drain 22 is carried out as follows. Into the socket joint receptacle 15 at the end of the branch drain 2 a pipe stump 26 is inserted through the opening in the wall of the vertical duct element. Next, the opening around the pipe stump 26 is grouted with filling mix 18, while at the same time the grouting with mix 18 of the gap between the edges of the hole in the false ceiling element and the walls of the vertical duct element is also performed. Alternatively, the pipe stump 26 may also be connected by means of a flange joint 14, 16, similarly as has been done in the embodiment of FIG. 4.

Figure 4:
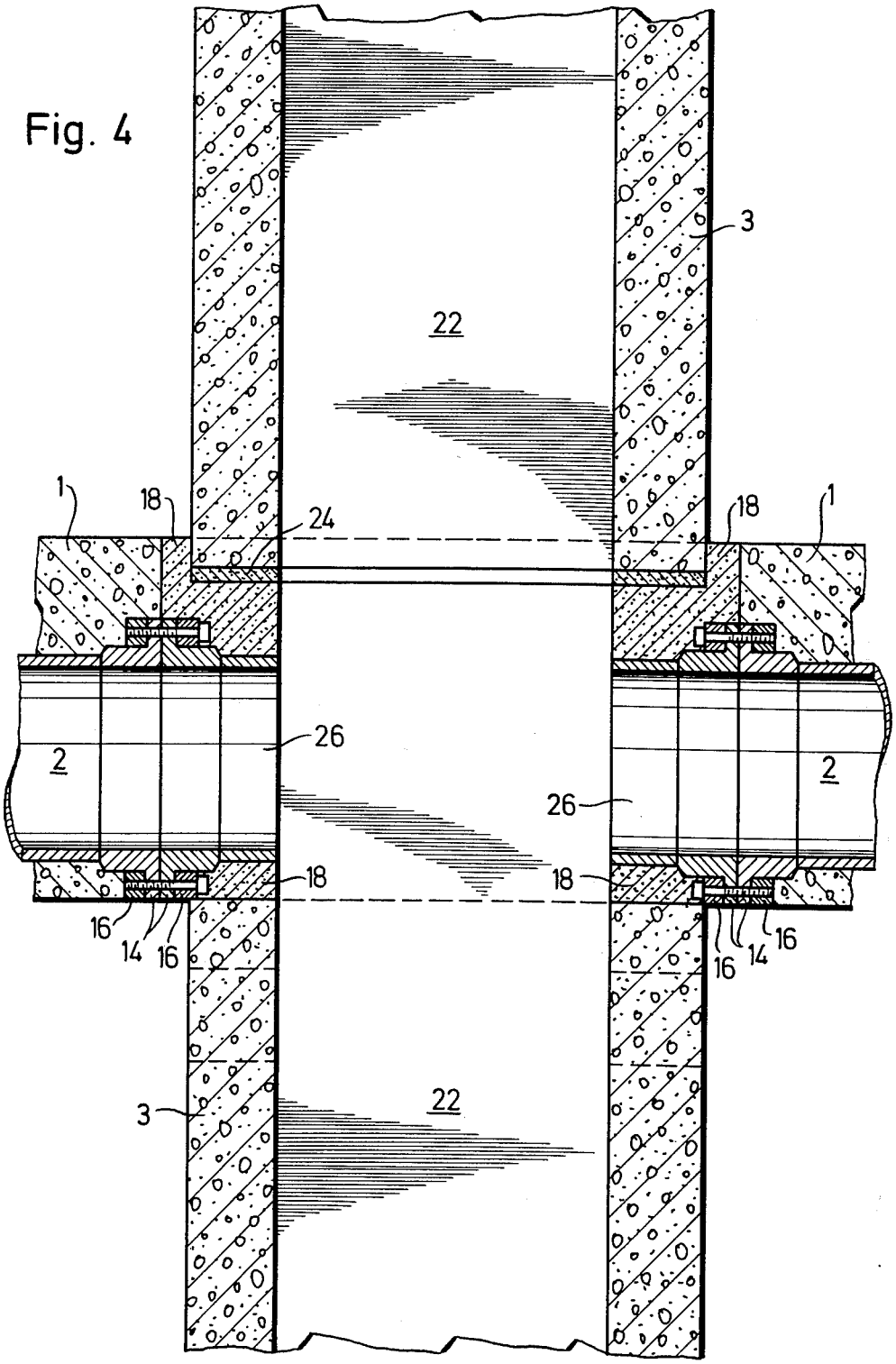
FIG. 4 shows the same as FIG. 2, according to another embodiment of the invention.

In FIG. 4, the connecting end both of the branch drain 2 and of the pipe stump 26 consists of a plastic material flange 14 and of a cast iron flange 16 packing it. The flange 16 on the branch drain has threaded holes, into which bolts are screwed through holes in the flange 16 of the pipe stump 26, whereby the plastic flanges 14 are tightened against each other. The opening around the pipe stump 26 in the wall of the vertical duct element 3 is then filled with sealing mix 18. The upper vertical duct element 3 is inserted through the opening in the false ceiling element of the next higher floor, and the gap between the false ceiling element 1 and the vertical duct elements 3 is filled with sealing mix 18.

The invention is by no means confined to the embodiments presented; it may vary in its structural details within the scope of the claims following below. For instance, the branch drain may be constructed to form one single unit without separate pipe stump 26 when the false ceiling element is concreted on the site. Futhermore, the drain duct 22 may be provided with a plastic coating.

I claim:

1. A drain and duct system for sanitary and plumbing fixtures of a building having a ready-furnished concrete floor element into which drains which are in fluid connection with connection studs have been concreted, both the branch drains and the studs being encased in the ready-furnished concrete floor element in accordance with a predesigned floor space plan for positioning the fixtures on said floor space, said floor element containing an opening for receiving a vertical duct, the system comprising:

a. vertical duct elements stacked one upon the other and fitted into said opening in said floor element, said vertical duct elements having a plurality of vertical ducts therein, one of said vertical ducts constituting a vertical drain, said vertical drain duct containing an opening therein, and one of said vertical ducts constituting a ventilation duct;

b. said ready-furnished concrete floor element being furnished with said encased drains and said encased connection studs;

c. said drains being encased in said floor element to run generally horizontally through said floor element wherein one of said drains is a main drain for connecting with branch drains, said main drain having an opening for connecting with said vertical drain duct, said branch drains being located throughout said floor element in accordance with said predesigned floor space plan;

d. said plurality of connection studs being in fluid connection with said branch drains for connecting said sanitary and plumbing fixtures with said branch drains; and e. a pipe stump for connecting said main branch drain in said floor element with said vertical drain duct utilizing said opening in said vertical drain duct which coincides with said opening in said main branch drain, whereby selecting differently designed floor elements, said sanitary and plumbing fixtures may be located anywhere on said floor space.

2. System according to claim 1 characterized in that to the end of the drain (2) in the floor element (1) a pipe stump (26) has been affixed, which extends through an opening in the vertical duct element (3), and which opening around the pipe stump (26) has been grouted with sealing mix (18).

3. System according to claim 2, characterized in that the pipe stump (26) has been connected into a socket juncture receptacle (15) on the end of the drain (2).

4. System according to claim 2, characterized in that the pipe stump (26) has been connected with a flange (14, 16) on the end of the branch drain by a screwed flange connection.

* * * * *